US008205535B2

(12) United States Patent
Kempf et al.

(10) Patent No.: US 8,205,535 B2
(45) **Date of Patent: *Jun. 26, 2012**

(54) FIBER CABLE MADE OF HIGH-STRENGTH SYNTHETIC FIBERS FOR A HELICOPTER RECUE WINCH

(75) Inventors: Florian Kempf, Kaufbeuren (DE); Juergen Fischer, Augsburg (DE)

(73) Assignee: Eurocopter Deutschland GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/957,903

(22) Filed: Dec. 1, 2010

(65) Prior Publication Data

US 2011/0078996 A1 Apr. 7, 2011

Related U.S. Application Data

(63) Continuation of application No. 12/207,831, filed on Sep. 10, 2008, now Pat. No. 7,866,245.

(30) Foreign Application Priority Data

Sep. 10, 2007 (DE) ..... 10 2007 042 680

(51) Int. Cl.
*D04C 1/06* (2006.01)

(52) U.S. Cl. ..... 87/1; 87/9; 87/13

(58) Field of Classification Search ..... 87/1, 3, 87/6, 8, 9, 13
See application file for complete search history.

(56) References Cited

U.S. PATENT DOCUMENTS

| | | | | |
|---|---|---|---|---|
| 5,834,942 | A | 11/1998 | De Angelis | |
| 6,247,359 | B1 | 6/2001 | De Angelis | |
| 6,289,742 | B1 | 9/2001 | De Angelis | |
| 6,321,520 | B1 | 11/2001 | De Angelis | |
| 6,341,550 | B1 | 1/2002 | White | |
| 6,392,551 | B2 | 5/2002 | De Angelis | |
| 7,240,599 | B2 | 7/2007 | Nolan | |
| 7,866,245 | B2 * | 1/2011 | Kempf et al. | 87/8 |
| 2001/0030608 | A1 | 10/2001 | DeAngelis | |
| 2005/0082083 | A1 | 4/2005 | Nolan | |

FOREIGN PATENT DOCUMENTS

| | | |
|---|---|---|
| DE | 2936111 | 3/1981 |
| EP | 1010803 | 6/2000 |

* cited by examiner

*Primary Examiner* — Shaun R Hurley
(74) *Attorney, Agent, or Firm* — Brooks Kushman P.C.

(57) ABSTRACT

A fiber cable for helicopter rescue winches includes a plurality of load-bearing synthetic-fiber strands braided with one another, at least one electrically conductive insert, and a wear indicator providing a visual check of a state of the fiber cable, where the load-bearing synthetic-fiber strands are encased in a radial direction by a friction-reducing stable fiber layer, an inner cable jacket, and outer cable jacket.

6 Claims, 5 Drawing Sheets

FIBER CABLE MADE OF HIGH-STRENGTH SYNTHETIC FIBERS FOR A HELICOPTER RECUE WINCH

CROSS-REFERENCE TO RELATED APPLICATIONS

This application is a continuation of U.S. Application Ser. No. 12/207,831 filed Sep. 10, 2008 (now U.S. Pat. No. 7,866,245), and claims priority to that case and to German Application No. 10 2007 042 680.3 filed Sep. 10, 2007, both of which are hereby incorporated by reference in their entirety.

BACKGROUND OF THE INVENTION

The present invention relates to a fiber cable made of high-strength synthetic fibers for a helicopter rescue winch.

Steel cables made of special steel having the material number 1.4314, in a 19×7 configuration, are used at present as the standard cable for helicopter rescue winches. The cables are exposed to large loads during operation. A disadvantage in this context is that the special-steel cables are susceptible to torsional, flexural, and kinking loads. This results in a short duration of use (usually limited to a maximum of 1,500 load cycles) for special-steel cables. Because special-steel cables furthermore have poor damage detectability, costly inspections at short maintenance intervals are necessary in order to check that the cable is undamaged. Further disadvantages of special-steel cables are inherent rotation behavior under load, susceptibility to corrosive media, and relatively high weight. Special-steel cables are also difficult to clean because of their relatively rough surface.

SUMMARY OF THE INVENTION

It is an object of the invention to further develop a cable for a helicopter winch so as to provide a cable having a longer duration of use, easy damage detectability, and/or a lower cable weight, while avoiding the aforesaid disadvantages.

The present invention provides a cable for the helicopter winch embodied as a fiber cable made of synthetic fibers, and encompassing multiple load-bearing synthetic-fiber strands braided with one another, at least one electrically conductive insert, and a wear indicator for visual checking of the fiber cable.

An advantage of the cable from multiple load-bearing synthetic-fiber strands braided with one another according to the present invention, is that the cable has a low weight, very little elongation under load, high fracture resistance, no inherent rotational torque, and good spliceability. Because plastic fibers are outstanding electrical insulators, the cable is equipped with an electrically conductive insert. This is necessary so that differences in electrical potential between the helicopter and the ground can be equalized. The potential difference occurs as a result of friction of the rotor blades against air molecules, which produces a static charge on the helicopter on the order of 10 kV to 100 kV. Equalization of this electrical potential is necessary in order to prevent an electric shock to persons being conveyed with the winch into the helicopter or from the helicopter to the ground. Because the cable according to the present invention furthermore comprises a wear indicator, damage to the fiber cable is detectable by a simple visual check.

According to a first embodiment of the invention, the load-bearing synthetic-fiber strands are encased, viewed in the radial direction, by a staple fiber layer, an inner cable jacket colored with a signal color, and an outer cable jacket. The required electrically conductive insert is embodied in fiber form in the present case and is braided into the staple fiber layer. The forces acting on the cable are carried exclusively by the cable core, i.e. by the load-bearing synthetic-fiber strands that are braided with one another. The purpose of the electrically conductive staple fiber layer arranged between the inner cable jacket and the load-bearing synthetic-fiber strands is to reduce friction between the cable core and cable jacket. As a wear indicator, the inner cable jacket is colored using a signal color, for example orange. This makes a wear indicator available in simple fashion, since in the event of damage to the outer cable jacket, the signal color of the inner cable jacket becomes visible so that cable damage is easily detectable. This construction is advantageous in particular because of the good adhesion between jacket and core, and the good protection of the cable core.

According to a second embodiment of the invention, the load-bearing synthetic-fiber strands are encased, viewed in the radial direction, by a staple fiber layer colored with a signal color, and an outer cable jacket. The electrically conductive insert is once again embodied in fiber form and is braided into the staple fiber layer colored with a signal color. Advantageously, in the present case the staple fiber layer serves on the one hand to inhibit friction between the cable jacket and cable core, and on the other hand as a weal" indicator in order to indicate damage to the outer jacket. The cable jacket also protects the load-bearing cable core from abrasion and UV radiation According to a third embodiment of the invention, the load-bearing synthetic-fiber strands are encased, viewed in the radial direction, by a staple fiber layer colored with a signal color, and an outer cable jacket. The required electrically conductive insert is once again embodied in fiber form and is braided into the outer cable jacket. Corresponding to the previous embodiment, the staple fiber layer once again serves as a wear indicator in the event of damage to the outer cable jacket, and to inhibit friction between the cable core and cable jacket. The fiber-shaped electrically conductive insert braided into the cable jacket provides electrical conductivity for the cable structure, as already stated, and at the same time contributes to a reduction in wear resulting from abrasion of the synthetic fibers.

The embodiments presented above of the cable according to the present invention for a helicopter winch are preferably impregnated with a flexible resin system. This has the effect of sealing the cable against the penetration of water and dirt, i.e. in particular ensures easier cleaning of the cable.

According to a fourth embodiment of the invention the electrically conductive insert is embodied, viewed in the radial direction, as a wire forming the cable core, around which the load-bearing synthetic-fiber strands are braided; the outer periphery of the fiber cable is equipped with a colored coating. Corresponding to the embodiments already described, in this case as well only the synthetic-fiber strands braided with one another are load-bearing, whereas the wire forming the cable core simply ensures the necessary electrical conductivity of the cable. The colored coating once again enables easy visual checking of the cable, since the corresponding location would be easy to detect in the event of damage.

According to a fifth embodiment of the invention, the electrically conductive insert encompasses multiple wires, the number of wires corresponding to the number of load-bearing synthetic-fiber strands, and one wire being braided into each of the synthetic-fiber strands. Corresponding to the previous embodiment, the wear indicator is once again embodied as a colored coating.

It is also conceivable, in the context of the fourth and fifth embodiments of the cable according to the present invention for a helicopter winch, for the wear indicator to be embodied in such a way that each of the load-bearing synthetic-fiber strands is equipped with a colored coating.

In embodiments four and five, the cable is preferably encased in a further enveloping surface with high temperature resistance, for example aramid or Zylon©. This has the advantage that the provision of this enveloping surface guarantees short-term temperature resistance up to 300° C.

In order to inhibit the penetration of dirt and water, this enveloping surface is advantageously impregnated with a flexible resin system.

In embodiments four and five, the wires are sheathed with a plastic casing. This has the effect of ensuring sufficient protection of the wires from chemical influences.

Preferably, the cable comprises eight or twelve load-bearing synthetic-fiber strands braided with one another, and the synthetic-fiber strands are made from aramid, Dyneema©, Vectran©, or Zylon©.

Because of its good electrical conductivity, the electrically conductive insert is preferably made from copper.

Further advantages, features, and possible applications of the present invention are evident from the description below in conjunction with the exemplifying embodiments presented in the drawings.

BRIEF DESCRIPTION OF THE DRAWINGS

The invention will be described below in further detail with reference to exemplifying embodiments.

The terms and associated reference characters used in the List of Reference Characters set forth below are used in the Description, the Claims, the Abstract, and the drawings. In the drawings:

DETAILED DESCRIPTION OF THE PREFERRED EMBODIMENT(S)

Figure 1:
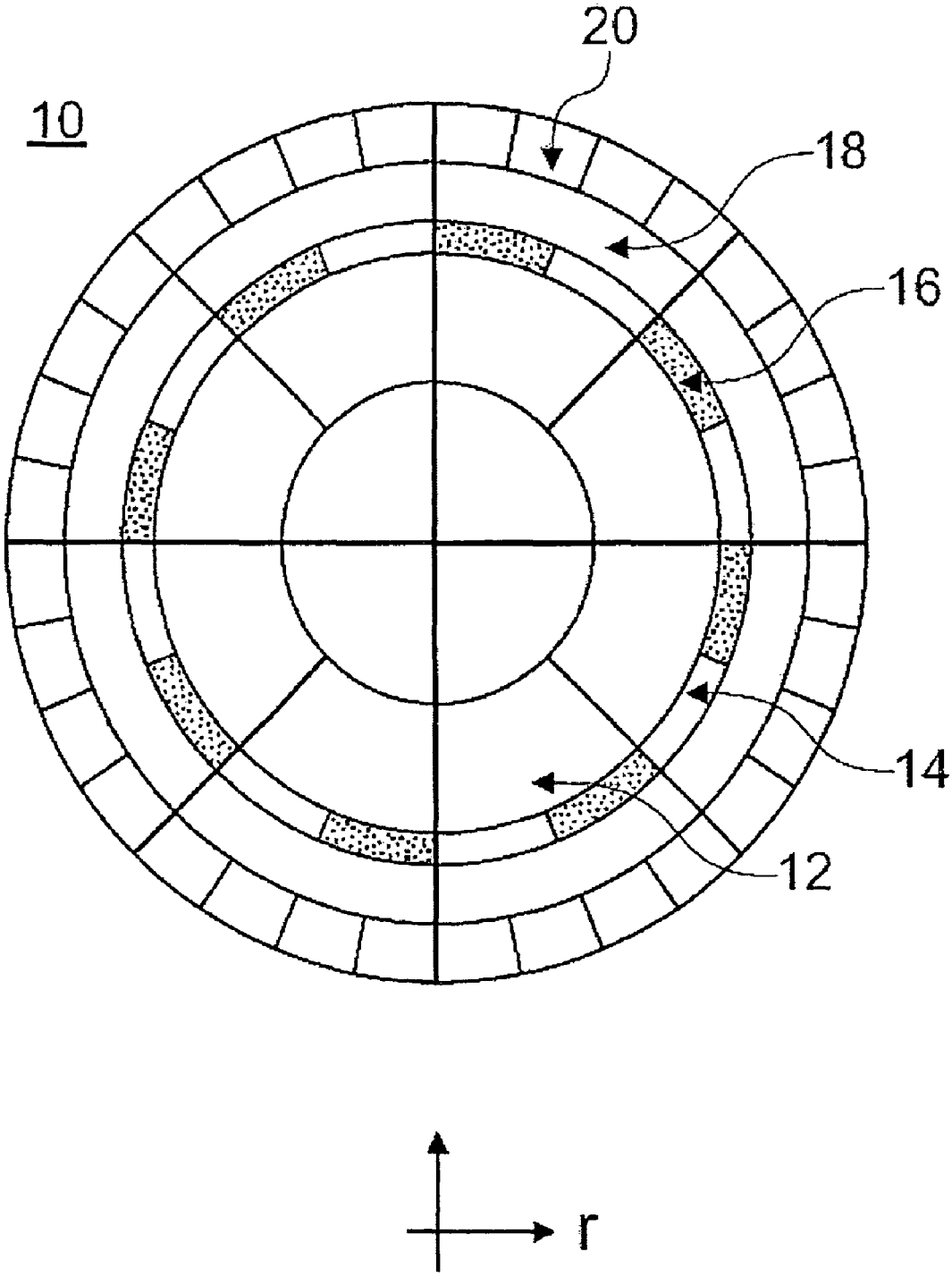
FIG. 1 is a schematic sectioned depiction of a first embodiment of the cable according to the present invention for a helicopter winch.

In order to avoid repetitions, in the description that follows and in the Figures, identical components and constituents are labeled with identical reference characters unless further differentiation is necessary or advisable.

The cable for a helicopter winch, depicted more or less schematically in a sectioned view in FIG. 1 and labeled in its entirety with the reference number 10, encompasses twelve load-bearing synthetic-fiber strands 12 braided with one another. Synthetic-fiber strands 12 are in the present case made from Dyneema©.

These twelve braided Dyneema©° synthetic-fiber strands 12 constitute the actual cable core. A staple fiber layer 14 is arranged around this cable core. A thin layer of copper wires is braided into staple fiber layer 14 as an electrically conductive insert 16, in order to ensure the necessary electrical conductivity for cable 10.

Staple fiber layer 14 is surrounded, viewed in radial direction r, by an inner cable jacket 18 and by an outer cable jacket 20 encasing inner cable jacket 18 Inner cable jacket 18 and outer cable jacket 20 are each made of synthetic fibers.

Inner cable jacket 18 is furthermore colored with a signal color, in the present case orange Inner cable jacket 18 thus serves as a wear indicator, since in the event of damage to outer cable jacket 20, inner cable jacket 18 becomes visible so that cable damage can easily be detected visually.

Outer cable jacket 20 is furthermore impregnated with a flexible polyurethane resin system in order to prevent the penetration of water and dirt.

The adhesion of jacket and core, and the protection of the cable core, are extremely high with this construction.

Figure 2:
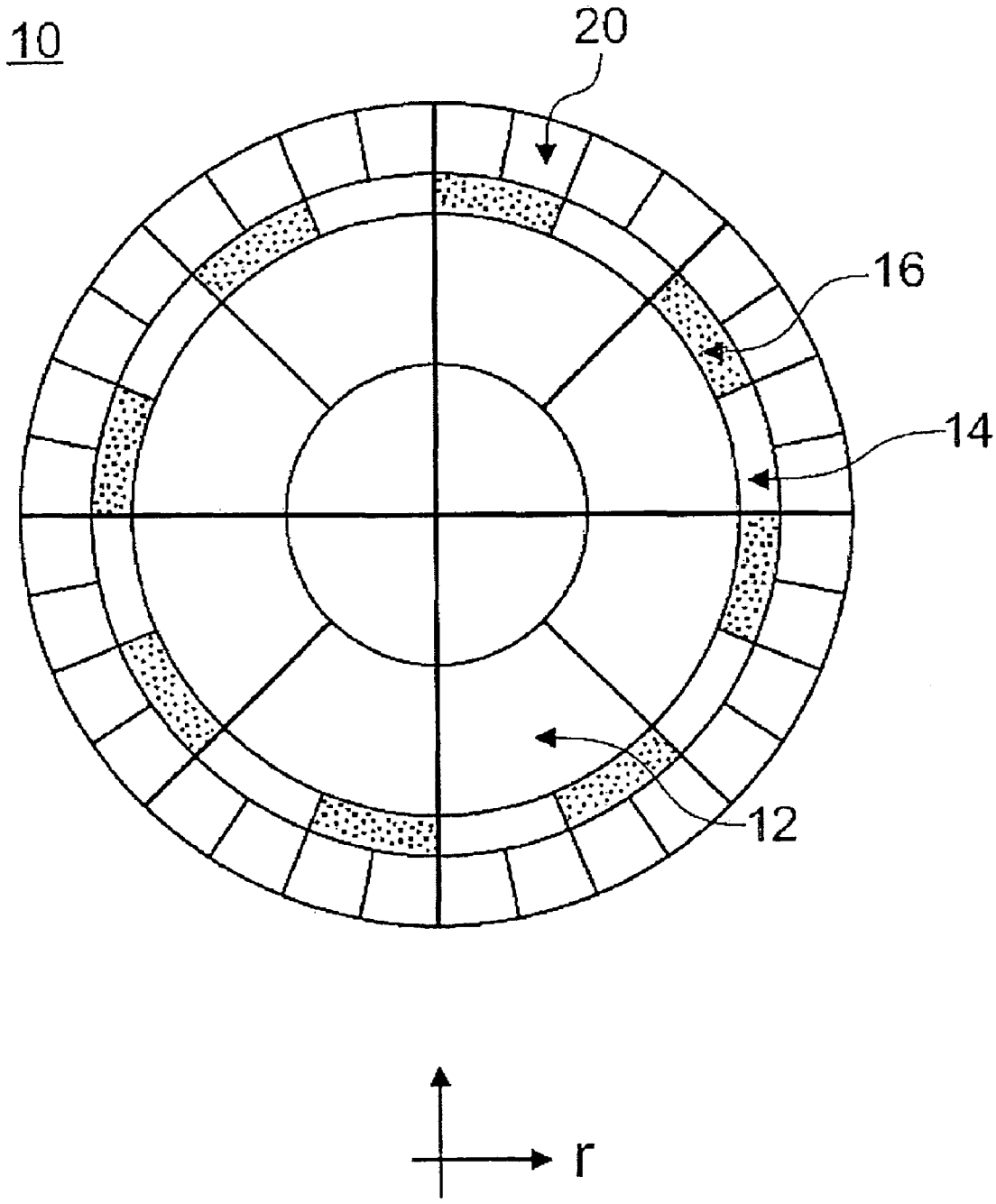
FIG. 2 is a schematic sectioned depiction of a second embodiment of the cable according to the present invention.

In the embodiment of the invention depicted in FIG. 2 as well, twelve load-bearing synthetic-fiber strands 12 braided with one another form the core of the cable structure. Arranged around the cable core is a staple fiber layer 14 into which an electrically conductive insert 16 in the form of copper fibers is once again braided, in order to ensure electrical conductivity for cable 10.

Staple fiber layer 14 is additionally colored with a signal color, for example orange. Staple fiber layer 14 is in turn surrounded by an outer cable jacket 20. In contrast to the embodiment depicted in FIG. 1, in this case staple fiber layer 14 performs two functions: on the one hand it serves to inhibit friction between the cable jacket and cable core, and on the other hand it serves as a wear indicator in order to indicate damage to outer jacket 20.

Corresponding to the embodiment described in FIG. 1, the outer cable jacket is once again sealed with a flexible polyurethane resin system in order to prevent the penetration of dirt and water.

Figure 3:
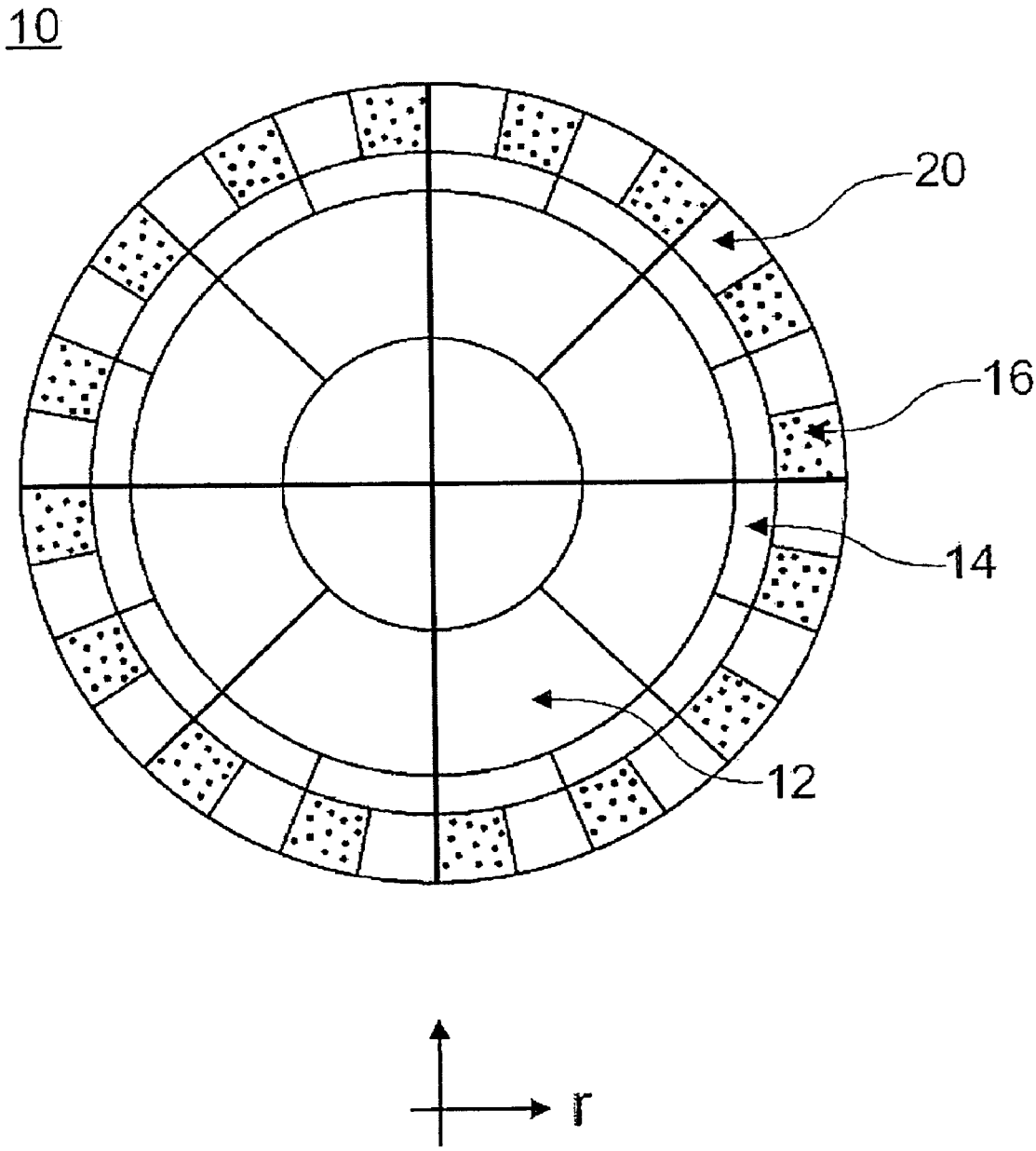
FIG. 3 is a schematic sectioned depiction of a third embodiment of the cable according to the present invention.

In the embodiment depicted in FIG. 3, cable 10 once again comprises a cable core made of Dyneema, made up of twelve load-bearing synthetic-fiber strands 12 braided with one another. The cable core is enclosed by a staple fiber layer 14 colored with a signal color, and by an outer cable jacket 20. Electrically conductive insert 16 is braided into outer cable jacket 20 in the form of copper fibers.

Staple fiber layer 14, colored with the signal color, serves to indicate wear in the event of damage to outer cable 20, and to inhibit friction between the cable core and cable jacket. The copper fibers introduced into outer cable jacket 20 in order to impart electrical conductivity to the cable structure also contribute, simultaneously, to a reduction in wear due to abrasion of the synthetic fibers. Corresponding to the first and second embodiments, outer cable jacket 20 is once against sealed with a flexible resin system to prevent penetration of water and dirt.

Figure 4:
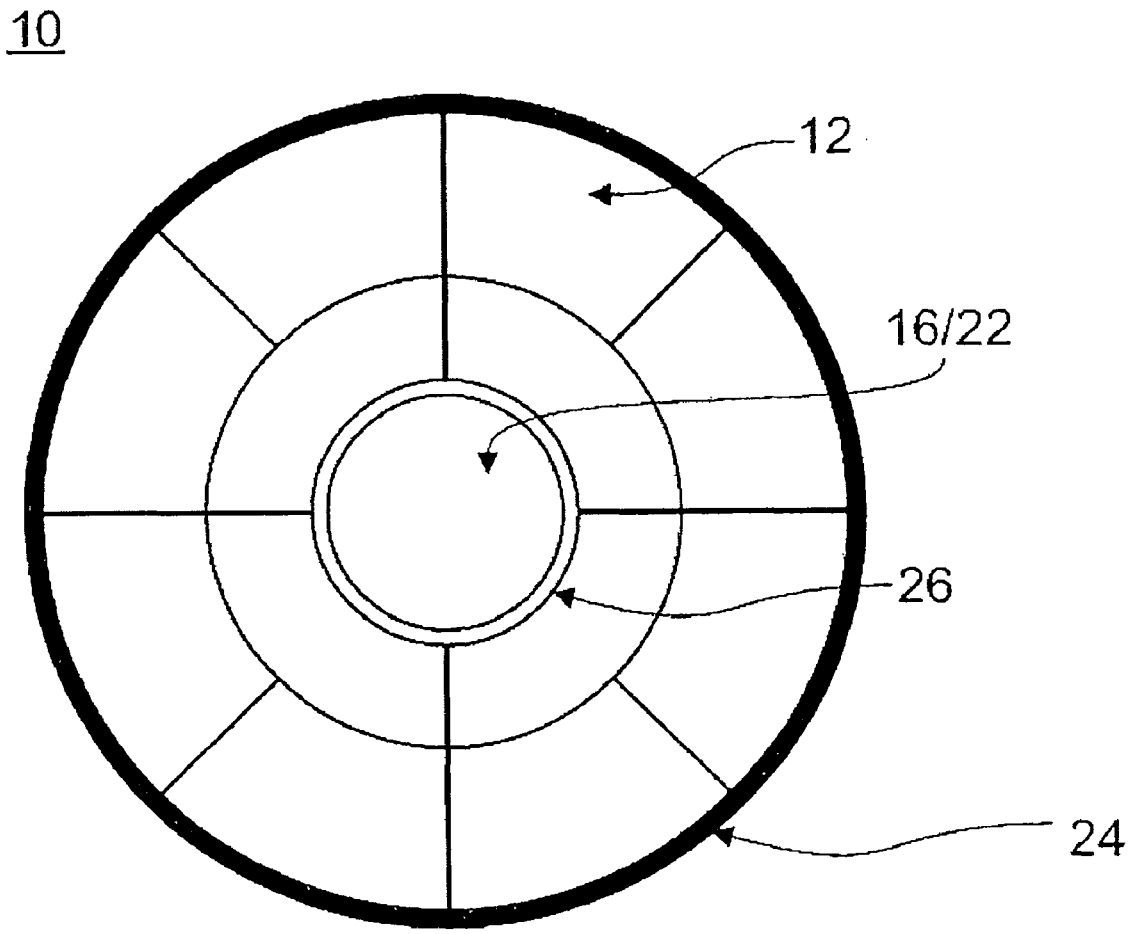
FIG. 4 is a schematic depiction of a fourth embodiment of the cable according to the present invention.

The embodiment of the invention depicted in FIG. 4 comprises, as an electrically conductive insert, a single wire 22 forming the cable core, around which the twelve load-bearing synthetic-fiber strands 12 made of Dyneema are braided. Once again, only synthetic-fiber strands 12 that are braided with one another are loadbearing.

The cable is additionally equipped with a colored coating 24, in the present case embodied as a polyurethane coating; and wire 22 is encased in a plastic sheath 26. While plastic sheath 26 protects the wire from chemical influences, the colored coating 24 selves as a wear indicator, since corresponding abrasion of the colored coating 24 enables easy visual checking of the cable. Coating 24 also, however, ensures the requisite coefficient of friction that is required so that a corresponding preload can be applied to cable 10 in a preload unit.

Figure 5:
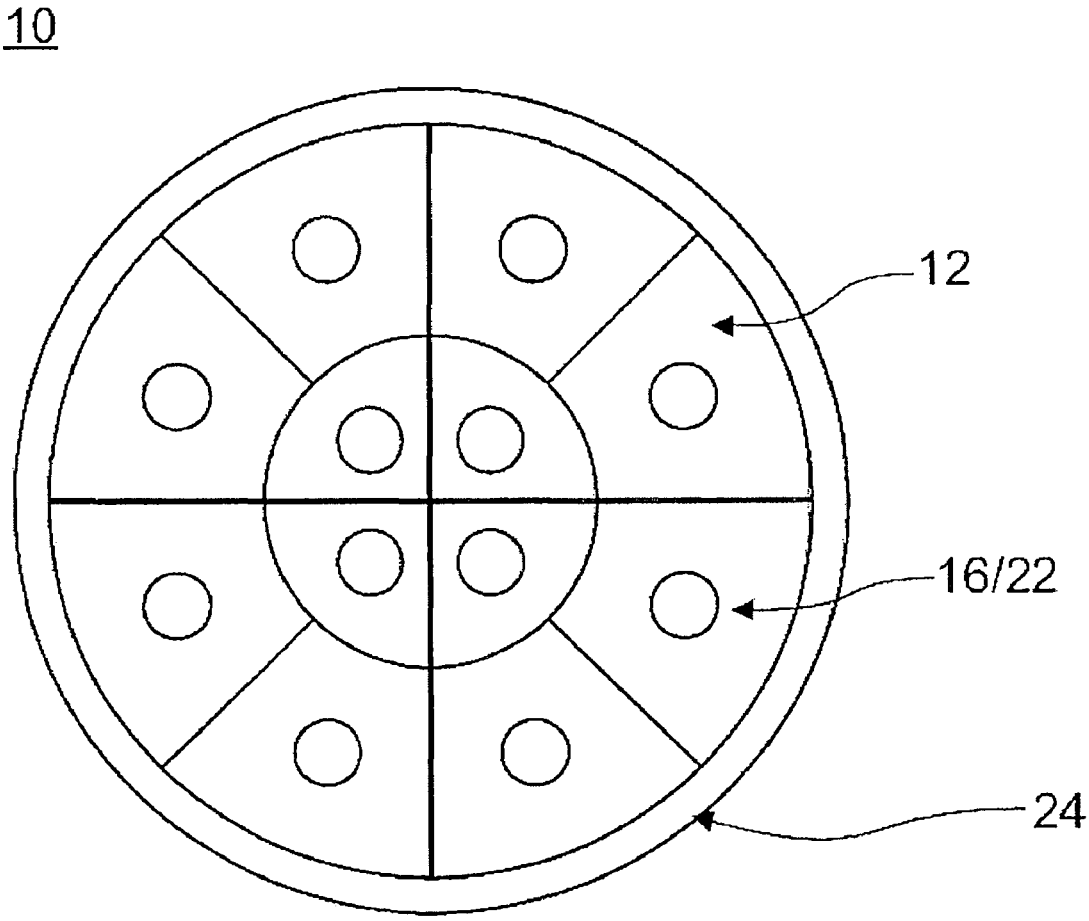
FIG. 5 is a schematic depiction of a fifth embodiment of the cable according to the present invention.

According to the last embodiment depicted in FIG. 5, the electrical conductivity of cable 10 is implemented by way of copper wires 22 braided into the individual cable strands 12.

To protect the copper conductors from chemical influences, they are once again encased in a plastic sheath 26, similarly to electrical conductors.

To ensure sufficient temperature resistance, the embodiments of cable 10 presented in FIGS. 4 and 5 can be equipped with an additional casing made of a material having high temperature resistance. This casing could be made, for example, of Zylonc© or aramid. These types of fiber have very high decomposition temperatures and exhibit poor thermal conductivity, thus ensuring short-term (<5 sec) temperature resistance at up to 300° C. To decrease wear caused by abrasion and light, it is advisable to coat this casing with a polyurethane resin.

What is claimed is:

1. A fiber cable for a helicopter rescue winch, the fiber cable comprising:

an electrically conductive wire;

a plastic sheath encasing said wire;

a plurality of load-bearing synthetic-fiber strands braided with one another and encasing said plastic sheath, wherein forces acting on the cable are carried exclusively by said plurality of load-bearing synthetic-fiber strands; and a coating encasing said plurality of load-bearing synthetic-fiber strands.

2. The fiber cable of claim 1, wherein said wire forms an innermost core of said fiber cable.

3. The fiber cable of claim 1, wherein said wire is one of a plurality of wires that are braided into said plurality of load-bearing synthetic-fiber strands.

4. A fiber cable for a helicopter rescue winch, the fiber cable comprising:

an electrically conductive, single wire core;

a plastic sheath encasing said wire core;

a plurality of load-bearing synthetic-fiber strands braided with one another and encasing said plastic sheath, wherein forces acting on the cable are carried exclusively by said plurality of load-bearing synthetic-fiber strands; and a coating encasing said plurality of load-bearing synthetic-fiber strands.

5. The fiber cable of claim 4, wherein said coating is polyurethane.

6. A fiber cable for a helicopter rescue winch, the fiber cable comprising:

a plurality of load-bearing synthetic-fiber strands braided with one another, wherein forces acting on the cable are carried exclusively by said plurality of load-bearing synthetic-fiber strands; and plural electrically conductive, wires braided into said plurality of load-bearing synthetic-fiber strands; a plastic sheath encasing each of said wires; and a coating encasing said plurality of load-bearing synthetic-fiber strands.

* * * * *